US006134933A

United States Patent [19]

Yamamoto et al.

[11] Patent Number: 6,134,933

[45] Date of Patent: Oct. 24, 2000

[54] METHOD AND SYSTEM FOR SUPPRESSING SURFACE OXIDE FILM DURING HOT FINISH ROLLING

[75] Inventors: Mikio Yamamoto; Junsou Fukumori; Tsutomu Kawamizu, all of Hiroshima; Kyung-Zoon Min, Tokyo, all of Japan; Sang-Wook Ha, Cheonnam; Seung-Sam Lee, Kyungbuk, both of Rep. of Korea

[73] Assignee: Mitsubishi Heavy Industries, Ltd., Tokyo, Japan

[21] Appl. No.: 09/205,293

[22] Filed: Dec. 4, 1998

[30] Foreign Application Priority Data

Dec. 5, 1997 [JP] Japan ..... 9-335236

[51] Int. Cl.[7] ..... B21B 27/06; B21B 45/04

[52] U.S. Cl. ..... 72/201; 72/39

[58] Field of Search ..... 72/39, 40, 200, 72/201, 202, 364, 8.5, 11.3, 12.2

[56] References Cited

U.S. PATENT DOCUMENTS

| | | | |
|---|---|---|---|
| 3,514,984 | 6/1970 | Cook | 73/201 |
| 4,043,166 | 8/1977 | Leroy | 72/39 |
| 5,235,840 | 8/1993 | Blazevic | 72/39 |
| 5,694,799 | 12/1997 | Wolpert et al. | 72/201 |

FOREIGN PATENT DOCUMENTS

| | | | |
|---|---|---|---|
| 7-171610 | 7/1995 | Japan . | |
| 2555798 | 9/1996 | Japan . | |
| 8-300003 | 11/1996 | Japan . | |
| 982-838 | 12/1982 | U.S.S.R. | 72/39 |

*Primary Examiner*—Rodney A. Butler

[57] ABSTRACT

A plurality of finishing mills for finish rolling a rolled material are located in a row to configure a finishing mill group. First to third surface coolers for cooling surfaces of the rolled material are located on an entry side of each of first, second and third finishing mills of the finishing mill group, and the amount of cooling water jetted at the rolled material by each surface cooler under a command of a controller is set at 4,000 liters/min·m$^2$, whereby the thickness of scale is restricted to 5 $\mu$m or less.

7 Claims, 8 Drawing Sheets

METHOD AND SYSTEM FOR SUPPRESSING SURFACE OXIDE FILM DURING HOT FINISH ROLLING

BACKGROUND OF THE INVENTION

1. Field of the Invention

The present invention relates to a method and a system for suppressing a surface oxide film during hot finish rolling of a strip material.

2. Description of Related Art

When iron contacts a gas, such as oxygen or air, at a high temperature during rolling of a strip material, a film of the reaction product, i.e., scale, is formed on the surfaces of the strip material. This scale may exert an adverse influence, such as oxidation, on the strip material, and should be removed. The customary practice for removing scale formed on a strip material has been to apply a jet of pressurized water at the surface of the strip material.

FIG. 8 is a schematic view illustrative of a scale removing device of a conventional hot finishing mill system.

With a conventional hot finishing mill system as shown in FIG. 8, a plurality of finishing mills, i.e., 1st to 7th finishing mills 101, 102, 103, 104, 105, 106, and 107, are provided in a row along the direction of transport of a rolled material S downstream of a roughing mill (not shown) in the direction of transport. The finishing mills 101, 102, 103, 104, 105, 106, and 107 have a pair of (i.e., upper and lower) work rollers 201, 202, 203, 204, 205, 206, and 207, respectively. A finishing mill group 100 is constructed in this manner. On the entry side of this finishing mill group 100, a scale breaker 301 is provided for removing scale formed on the rolled material S. The scale breaker 301 has jet nozzles 302 above and below the rolled material S. These jet nozzles 302 direct jets of water at a high pressure of, for example, 200 kgf/cm$^2$, at upper and lower surfaces of the rolled material S to remove the scale.

Thus, the rolled material S transported after rough rolling from a slab by a roughing mill is conveyed to the entry side of the finishing mill group 100, where scale formed on the surfaces of the rolled material S is removed by the scale breaker 301 before finish rolling. In detail, water pressurized at, for example, 200 kgf/cm$^2$, is jetted through the upper and lower jet nozzles 302 at the upper and lower surfaces of the conveyed rolled material S to remove the adhering scale. The descaled rolled material S is then carried to the finishing mill group 100 for rolling by the work rollers 201, 202, 203, 204, 205, 206, and 207 of the 1st to 7th finishing mills 101, 102, 103, 104, 105, 106, and 107, where it is sequentially finish rolled to predetermined thicknesses.

With such a hot finishing mill system, when the duration of contact of the rolled material S with the work rollers 201, 202, 203, 204, 205, 206, and 207 is relatively long, the quality of the processed product improves; however, the formation of scale is accelerated. Thus, a conventional method for suppressing the formation of scale has been to cool the rolled material S before finish rolling. This method suppresses scale formation to some degree; however, further suppression of scale and further improvement in quality are desired for hot rolled products.

SUMMARY OF THE INVENTION

The present invention is directed to solving the above problem. Its object, therefore, is to provide a method and a system for suppressing a surface oxide film during hot finish rolling and it is designed to minimize the formation of scale on a rolled material, thereby avoiding scale defects and improving the quality of the resulting product.

According to a first aspect of the present invention for attaining the above-described object there is provided a method for suppressing a surface oxide film during hot finish rolling of a strip material by a row of finishing mills, comprising:

cooling an upper surface and a lower surface of the strip material on an entry side of each of a first predetermined number of finishing mills during the finish rolling of the strip material to repeat surface cooling and finish rolling of the strip material sequentially until the last of the first predetermined number of finishing mills is reached, thereby restricting the thickness of a surface oxide film of the strip material to 5 $\mu$m or less.

According to a second aspect of the invention, there is provided a system for suppressing a surface oxide film during hot finish rolling, comprising:

a finishing mill group including a plurality of finishing mills for finish rolling a strip material, the finishing mills being located in a row; and a plurality of surface coolers for cooling an upper surface and a lower surface of the strip material to restrict the thickness of a surface oxide film of the strip material to 5 $\mu$m or less, the surface coolers being located on an entry side of each of the first predetermined number of finishing mills of the finishing mill group.

According to a third aspect of the invention, there is provided the system for suppressing a surface oxide film during hot finish rolling as in the second aspect of the invention, and wherein the first, second, and third surface coolers for cooling the upper and lower surfaces of the strip material are located on the entry side of the first to third finishing mills, respectively, of the finishing mill group.

BRIEF DESCRIPTION OF THE DRAWINGS

The present invention will become more fully understood from the detailed description provided hereinafter and the accompanying drawings, which are given by way of illustration only, and these are not meant to be limitative of the present invention, and wherein.

DETAILED DESCRIPTION OF THE PREFERRED EMBODIMENT

The preferred embodiment of the present invention will now be described in detail with reference to the accompanying drawings.

Figure 1:
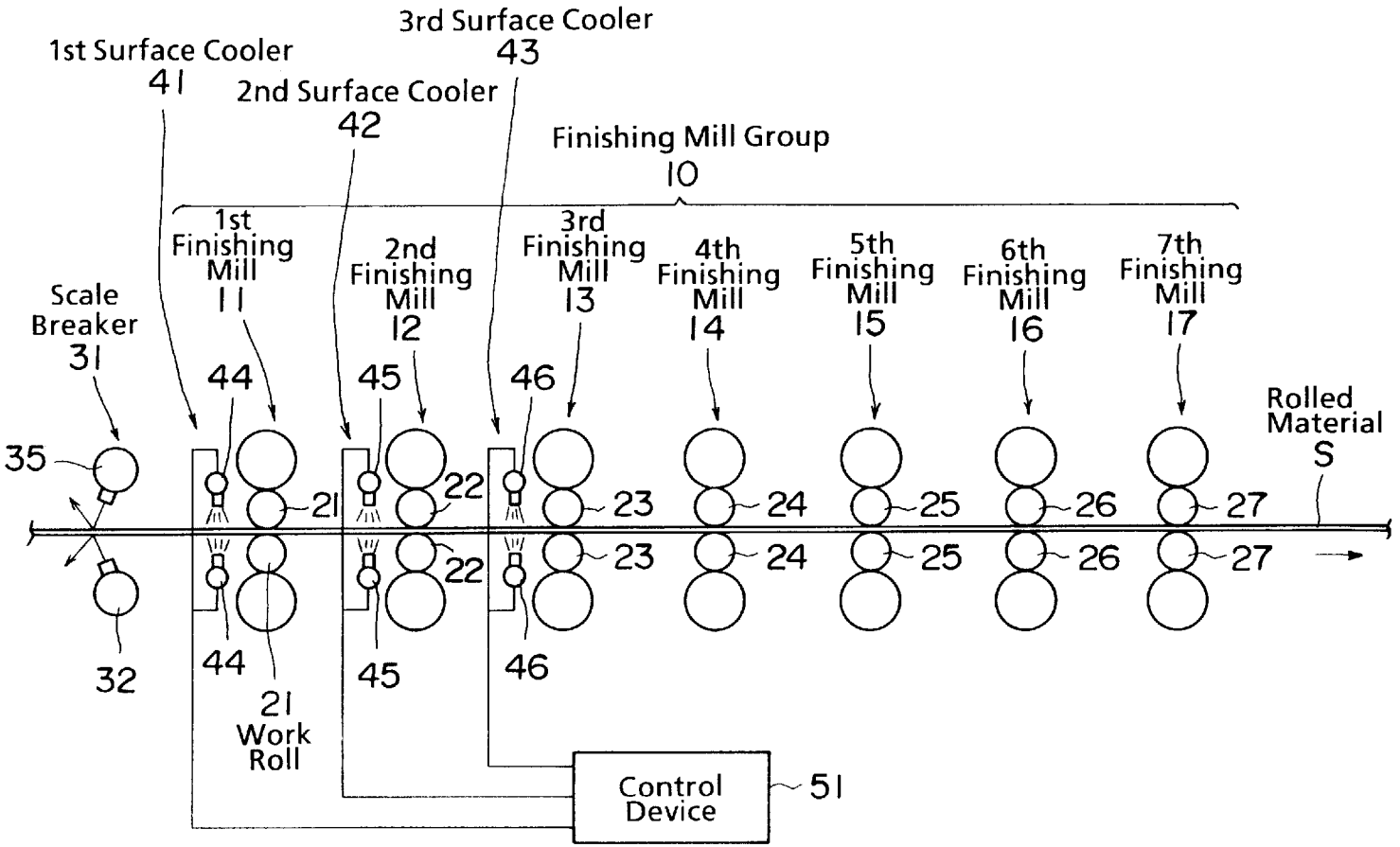
FIG. 1 is a schematic view illustrative of a surface oxide film suppressing system for performing a method for suppressing the formation of a surface oxide film during hot finish rolling in accordance with the preferred embodiment of the present invention.
Figure 2:
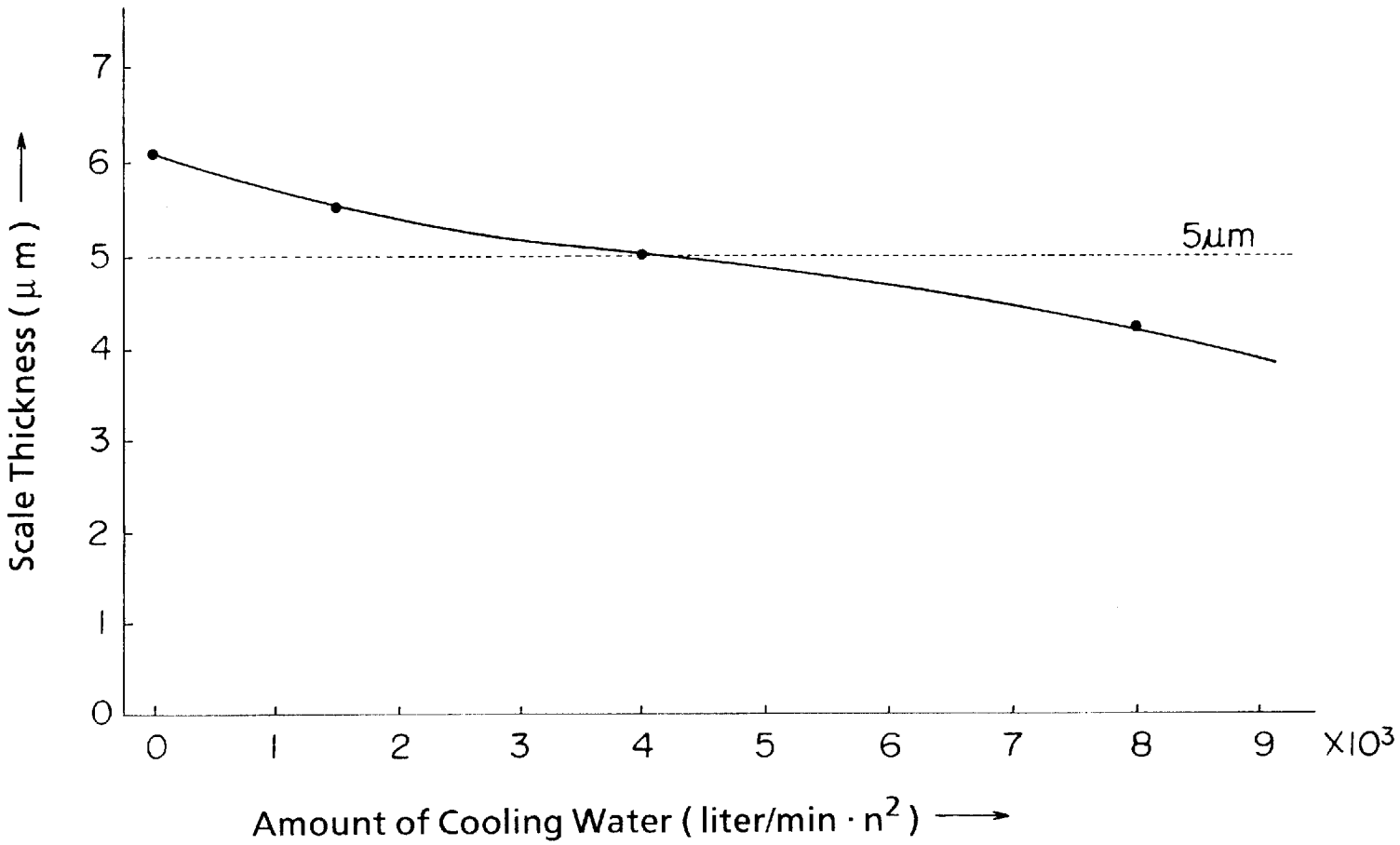
FIG. 2 is a graph showing the thickness of scale versus the amount of cooling water by a surface oxide film suppressing system during hot finish rolling in accordance with the preferred embodiment.
Figure 3:
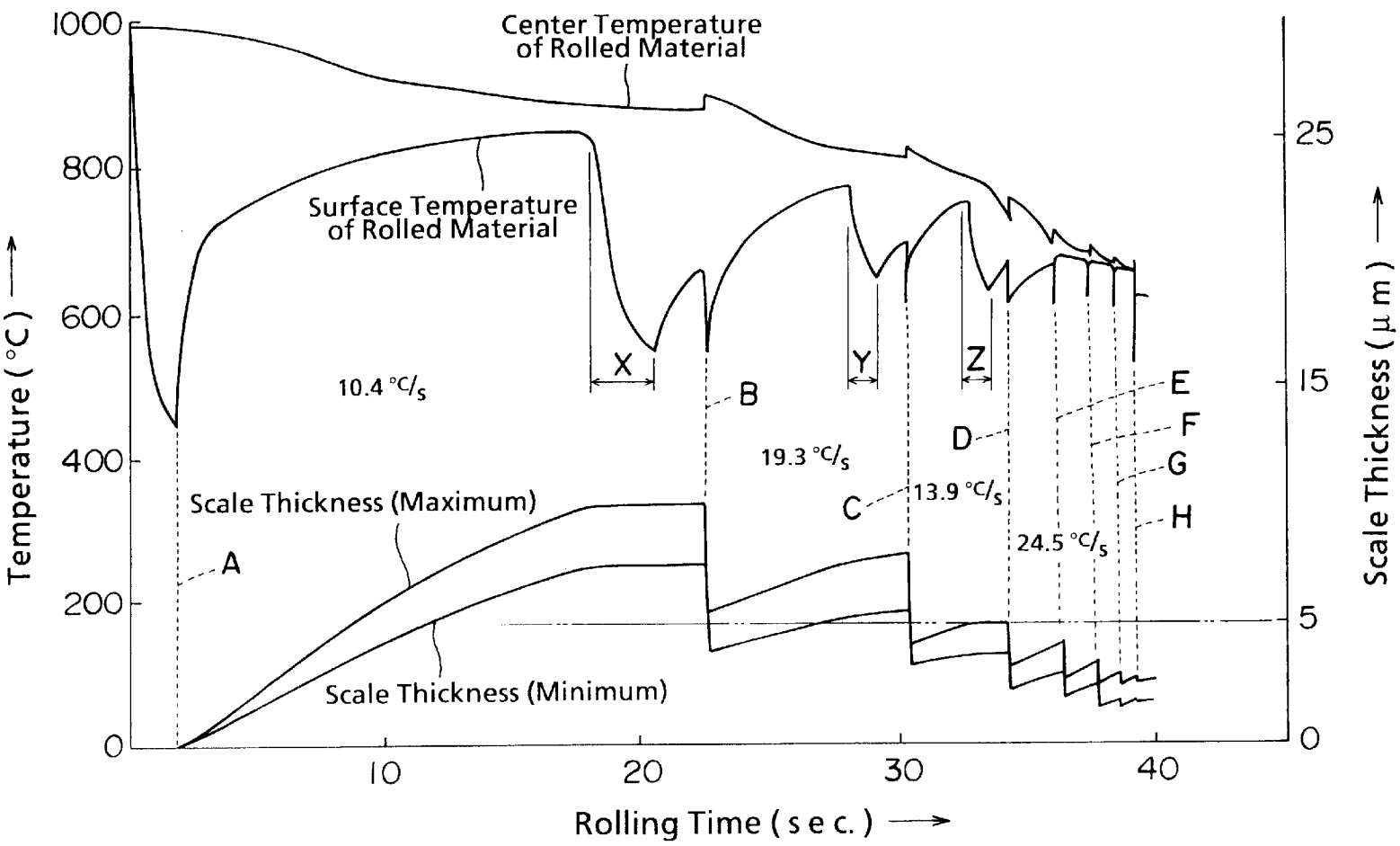
FIG. 3 is a graph showing the temperature of a rolled material and the thickness of scale during finish rolling.
Figure 4:
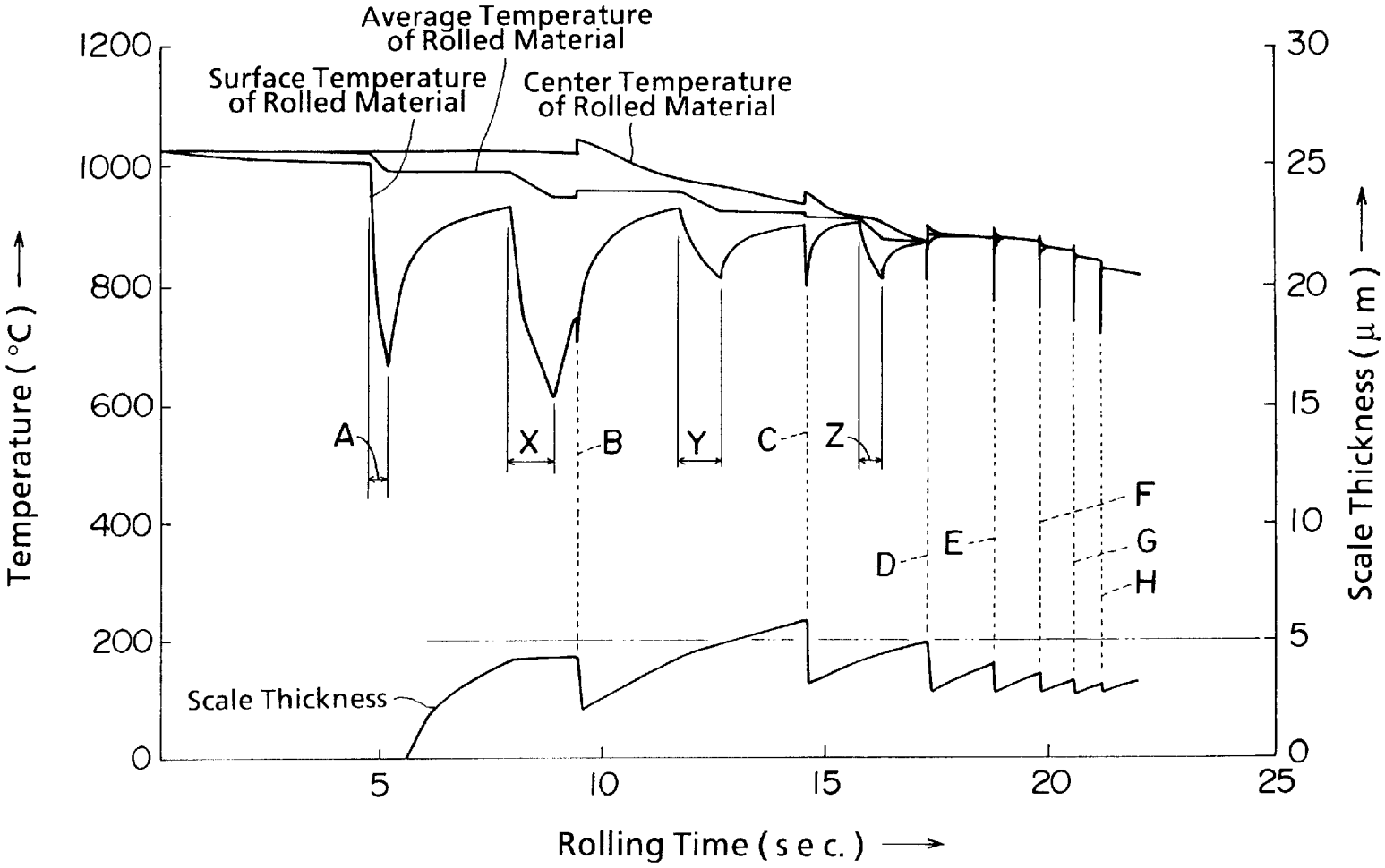
FIG. 4 is another graph showing the temperature of a rolled material and the thickness of scale during finish rolling.
Figure 5:
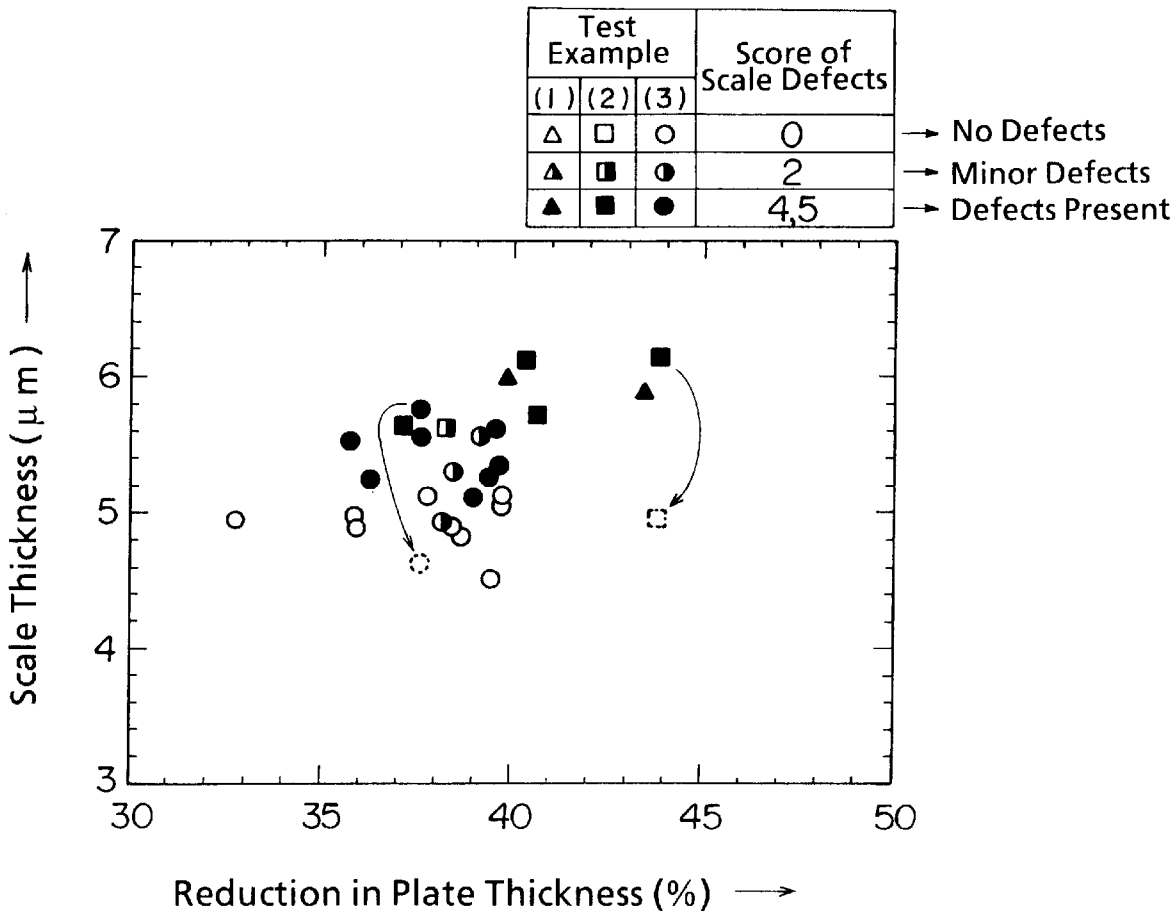
FIG. 5 is a graph showing the relation between the thickness of scale and scale defects during ordinary rolling.
Figure 6:
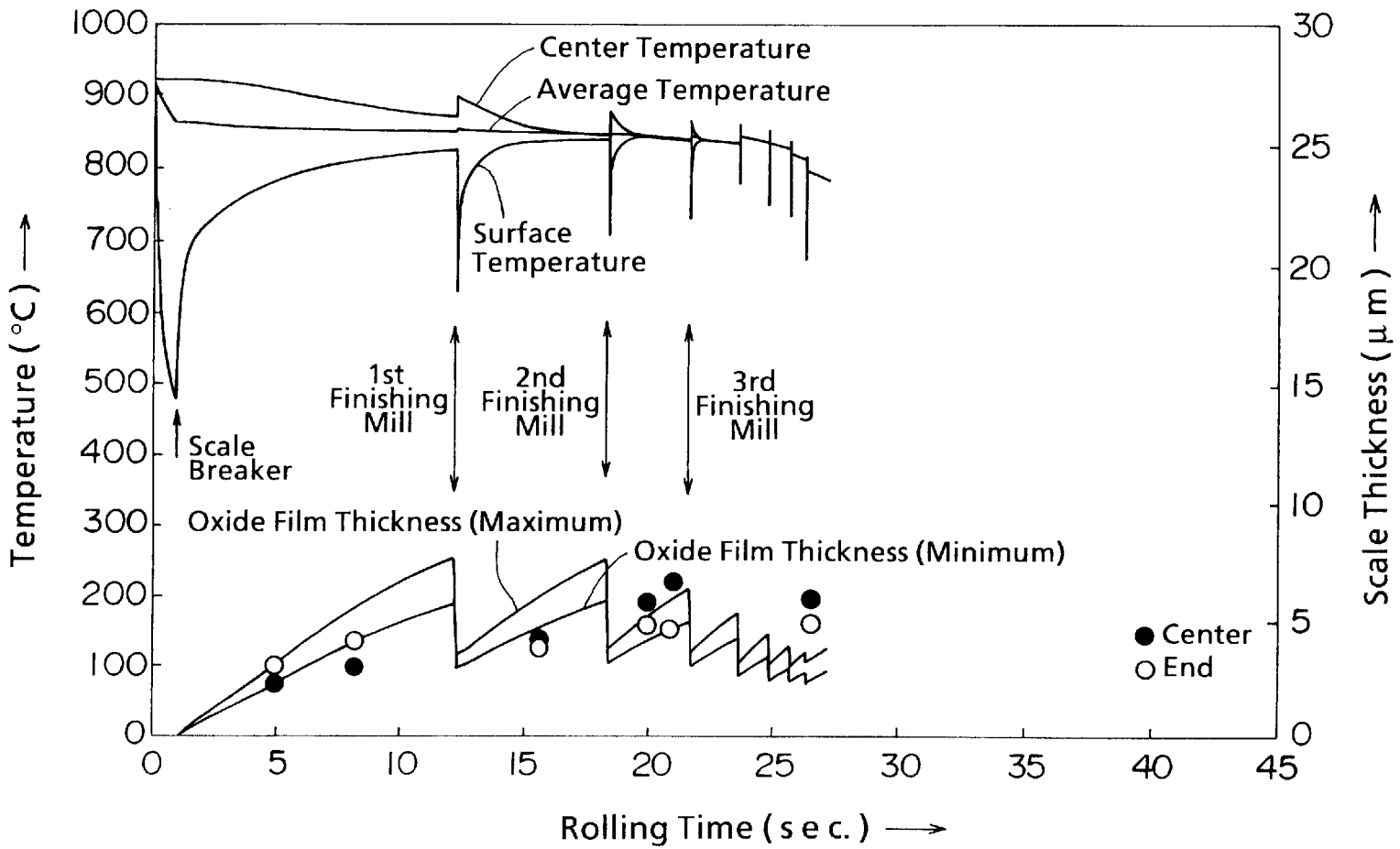
FIG. 6 is a graph showing the temperature of a rolled material and the thickness of scale during ordinary rolling.
Figure 7:
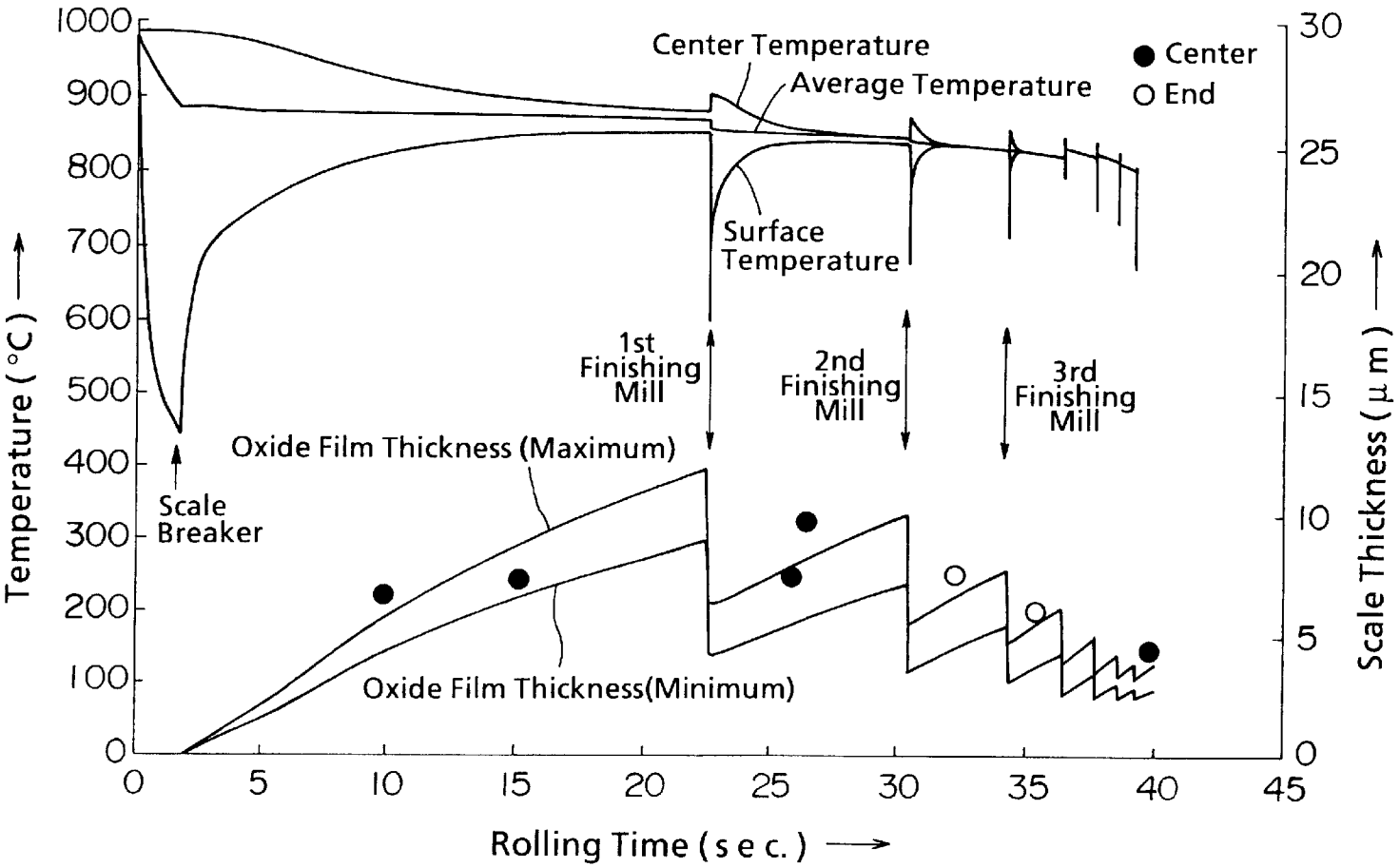
FIG. 7 is another graph showing the temperature of a rolled material and the thickness of scale during ordinary rolling.
Figure 8:
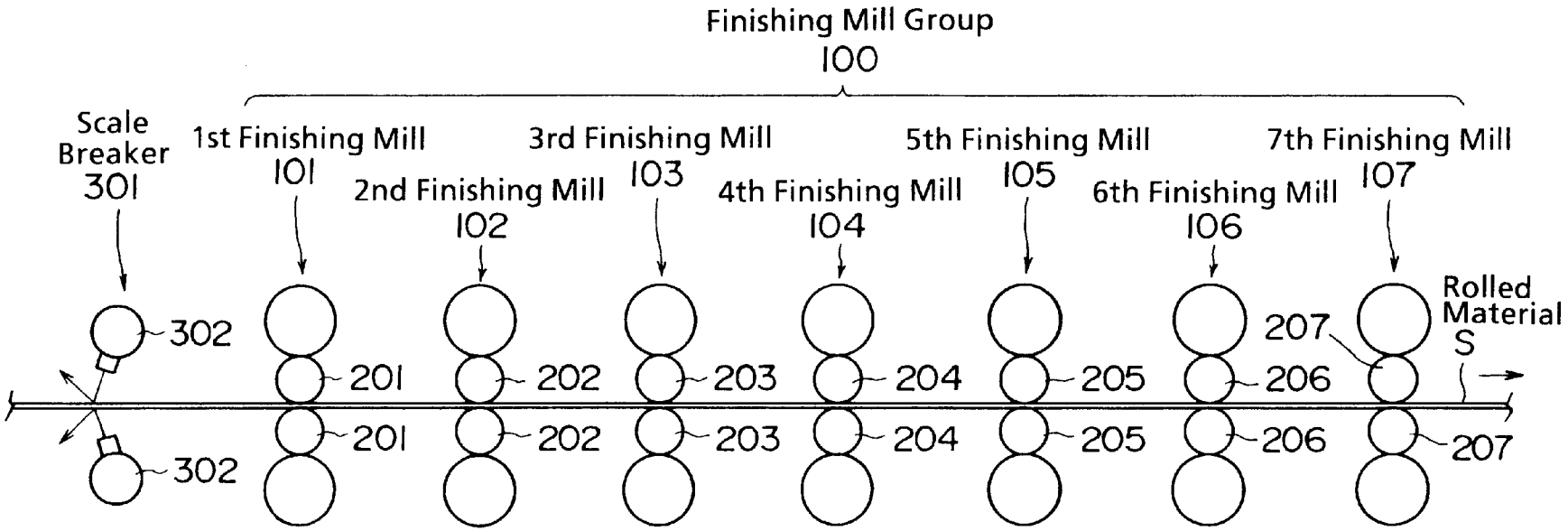
FIG. 8 PRIOR ART
FIG. 8 is a schematic view of a descaling device of a conventional hot finishing mill system.

FIG. 1 shows the outline of a surface oxide film suppressing system for performing a method for suppressing a surface oxide film during hot finish rolling in accordance with the present invention. FIG. 2 is a graph showing the thickness of scale versus the amount of cooling water by a surface oxide film suppressing system during hot finish rolling in accordance with the present embodiment. FIGS. 3 and 4 are graphs showing the temperature of a rolled material and the thickness of scale during finish rolling. FIG. 5 is a graph showing the relation between the thickness of scale and scale defects during ordinary rolling. FIGS. 6 and 7 are graphs showing the temperature of a rolled material and the thickness of scale during ordinary rolling.

First, the relationship between the thickness of scale and scale defects during rolling is explained by reference to FIG. 5. The graph, as illustrated in FIG. 5, shows test values on the third finishing mill in the finishing mill group. In three illustrative samples, Δ, □, ○, which are different in the material and plate thickness, an evaluation of scale defects is relatively low (scale score: 2.0 to 4.5) for a scale thickness of 5 μm or more, while an evaluation of scale defects is relatively high (scale score: 0) for a scale thickness of 5 μm or less, regardless of the magnitude of a percentage reduction in plate thickness.

The relationship between the temperature of a rolled material and the thickness of scale during finish rolling can be explained by reference to FIGS. 6 and 7. The graph of FIG. 6 concerns the samples rated as "No scale defects" in the evaluation of scale defects in the graph of FIG. 5. At both of the end (○) and center (●) of the sample, the scale thickness is 5 μm or less. The graph of FIG. 7, on the other hand, concerns the samples rated as "Scale defects present" in the evaluation of scale defects in the graph of FIG. 5. At both of the end (○) and center (●) of the sample, the scale thickness is about 5 μm or more.

These findings are illustrative of the fact that on the entry side of the 3rd finish rolling mill, scale defects occur when the scale thickness is 5 μm or more, while a rolled material without scale defects is obtained when the scale thickness is kept at 5 μm or less. Based on the above test results, further experiments and simulations have been performed. As a result, the present invention provides a system for suppressing a surface oxide film during hot finish rolling with the system restricting the thickness of scale to 5 μm or less and causing no scale defects.

With the system for suppressing a surface oxide film during hot finish rolling according to the preferred embodiment, as shown in FIG. 1, a plurality of finishing mills, i.e., a 1st finishing mill 11, a 2nd finishing mill 12, a 3rd finishing mill 13, a 4th finishing mill 14, a 5th finishing mill 15, a 6th finishing mill 16, and a 7th finishing mill 17, are located in a row along the direction of transport of a rolled material S downstream of a roughing mill (not shown) in the direction of transport. The finishing mills 11 to 17 have a pair of (i.e., upper and lower) work rollers 21, 22, 23, . . . 27, respectively. In this manner a finishing mill group 10 is formed. On the entry side of the finishing mill group 10, a scale breaker 31 is provided for removing scale formed on the rolled materialS. The scale breaker 31 has a pair of (i.e., upper and lower) jet nozzles 32 above and below the rolled material S. These jet nozzles 32 direct jets of high pressure water at upper and lower surfaces of the rolled material S to remove the scale.

On each entry side of the 1st finishing mill 11, the 2nd finishing mill 12 and the 3rd finishing mill 13, a 1st surface cooler 41, a 2nd surface cooler 42, and a 3rd surface cooler 43, respectively, are provided for cooling the upper and lower surfaces of the rolled material S. These 1st, 2nd and 3rd surface coolers 41, 42, 43 have a pair of (i.e., upper and lower) jet nozzles 44, 45, 46, respectively, above and below the rolled material S. These jet nozzles 44, 45, 46 direct jets of cooling water at the upper and lower surfaces of the rolled material S to cool the rolled material S, thereby lowering its surface temperature.

A control device 51 is connected to the 1st, 2nd and 3rd surface coolers 41, 42 and 43. Under the directive of the control device 51, a predetermined amount of cooling water is jetted at the rolled material S through the jet nozzles 44, 45, 46. FIG. 2 shows the thickness of scale versus the amount of cooling water, demonstrating that the amount of cooling water is desirably set at 4,000 liters/min·$m^2$ or more in order to restrict the scale thickness to 5 μm or less.

Thus, when the rolled material S is to be finish rolled by the hot finishing mill system of the embodiment shown in FIG. 1, the rolled material S transported after rough rolling from a slab by a roughing mill is conveyed to the entry side of the finishing mill group 10. There, scale formed on the surfaces of the rolled material S is removed by the scale breaker 31 before finish rolling. In detail, water is jetted at a high pressure through the upper and lower jet nozzles 32 of the scale breaker 31 at the upper and lower surfaces of the conveyed rolled material S to remove the adhering scale. The descaled rolled material S is carried to the finishing mill group 10 for rolling by the work rollers 21, 22, 23, 24 . . . 27 of the 1st finishing mill 11, the 2nd finishing mill 12, the 3rd finishing mill 13, the 4th finishing mill 14 . . . and the 7th finishing mill 17. At this time, the rolled material S is sequentially finish rolled to predetermined thicknesses while being cooled by the surface coolers 41, 42 and 43.

That is, prior to rolling being performed by the 1st finishing mill 11, a command of the amount of cooling water is fed by the control device 51 to the respective surface coolers 41, 42, 43. Under this directive, cooling water in an amount of 4,000 liters/min·$m^2$ is applied to the rolled material S through the jet nozzles 44 of the 1st surface cooler 41, whereby the rolled material S is cooled. The cooled rolled material S is rolled by the work rollers 21 of the 1st finishing mill 11. Then, cooling water in the same amount is applied to the rolled material S through the jet nozzles 45 of the 2nd surface cooler 42, whereby the rolled material S is cooled. The cooled rolled material S is rolled by the work rollers 22 of the 2nd finishing mill 12. Further, cooling water in the same amount is applied to the rolled material S through the jet nozzles 46 of the 3rd surface cooler 43, whereby the rolled material S is cooled. The cooled rolled material S is rolled by the work rollers 23 of the 3rd finishing mill 13. Then, the rolled material S is rolled by the work rollers 24 . . . 27 of the 4th to 7th finishing mills 14 . . . 17, whereby it is processed to predetermined thicknesses.

FIG. 3 is a graph showing the temperature of the rolled material S and the thickness of its scale during descaling and finish rolling of the material. In this graph, A represents the time of scale removal by the scale breaker 31. B, C, D, E, F, G and H represent the times of finish rolling by the 1st to 7th finishing mills 11, 12, 13, 14 . . . , respectively, and X, Y and Z represent the periods of cooling by the 1st to 3rd surface coolers 41, 42, 43.

As this graph further shows, the surface temperature of the rolled material S drops to 420° C., with most scale being removed, at the time A of scale removal by the scale breaker 31. However, the internal sensible heat tends to restore the original temperature to raise the surface temperature of the rolled material S, again forming scale. During the period X of cooling by the 1st surface cooler 41, the surface temperature of the rolled material S drops to 530° C., reducing the thickness of the scale to 7 to 10 μm. Then, the surface temperature of the rolled material S rises owing to sensible heat inside the rolled material S in an attempt to restore the original temperature. At the time B of finish rolling by the 1st finishing mill 11, however, the surface temperature of the rolled material S drops to 470° C., decreasing the scale thickness to 4 to 6 μm. During the period Y of cooling by the 2nd surface cooler 42, the surface temperature of the rolled material S drops to 630° C., decreasing the scale thickness to 6 to 8 μm. Then, the temperature rises, but at the time C of finish rolling by the 2nd finishing mill 12, the surface temperature of the rolled material S drops to 610° C., decreasing the scale thickness to 3 to 4 μm. Then, during the period Z of cooling by the 3rd surface cooler 43, the surface temperature of the rolled material S drops to 610° C., restricting the scale thickness to 3 to 5 μm. Then, the scale thickness increases as the temperature rises, but does not become greater than 5 μm.

By so repeating cooling by the 1st to 3rd surface coolers 41, 42, 43, and rolling after each cooling, one can see that the scale thickness of the rolled material S can be finally restricted to 5 μm or less, so that scale defects can be eliminated.

According to the subject invention, the cooling conditions of the surface coolers 41, 42 and 43 are 4,000 lites/min·$m^2$ as the amount of cooling water, and 1 m×plate thickness as the cooling range. The average temperature recovery rate (° C./second) when the surface cooler is in operation is compared with that when the surface cooler is not in operation. Between the scale breaker 31 and the 1st finishing mill 11, the average temperature recovery rate is 10.4° C./second in an operating state, and 19.9° C./second in a nonoperating state. Between the 1st finishing mill 11 and the 2nd finishing mill 12, the average temperature recovery rate is 19.3° C./second in the operating state, and 31.3° C/second in the nonoperating state. Between the 2nd finishing mill 12 and the 3rd finishing mill 13, the average temperature recovery rate is 13.9° C./second in the operating state, and 41.6° C./second in the nonoperating state. Between the 3rd finishing mill 13 and the 4th finishing mill 14, the average temperature recovery rate is 24.5° C./second when the surface coolers are in operation, and 53.5° C./second when the surface coolers are not in operation. These findings are indications of high cooling effect.

FIG. 4 is a graph illustrative of the temperature of the rolled material S and the thickness of its scale during descaling and finish rolling of this material under operating conditions different from those stated above. As this graph shows, during the period Z of cooling by the 3rd surface cooler 43, the surface temperature of the rolled material S drops to 820° C., restricting the scale thickness to 5 μm. Then, the scale thickness increases as the temperature rises, but does not become greater than 5 μm. By so repeating cooling by the 1st to 3rd surface coolers 41, 42, 43, and rolling after each cooling, one will observe that the scale thickness of the rolled material S can be finally restricted to 5 μm or less.

According to the surface oxide film suppressing system of the present invention, as shcwn in FIG. 5 the scale thickness is reduced from ● to ○ and from ■ to □, both cases representing values of 5 μm or less, and the absence of scale defects. Thus, recurrent heat (temperature recovery) during finish rolling is found to be properly suppressed.

In the above-described embodiment, the 1st, 2nd, and 3rd surface coolers 41, 42 and 43 are provided on the entry side of each of the 1st, 2nd and 3rd finishing mills 11, 12 and 13, respectively. However, the number of the surface coolers installed is not restricted to that indicated in this embodiment as shown in FIG. 1. Since the surface temperature of the rolled material S is desirably lowered below 900° C. by cooling, surface coolers for the 4th finishing mill 14 and subsequent finishing mills may also be included, if desired.

As described above, according to a first aspect of the invention, there is provided a method for suppressing a surface oxide film during hot finish rolling of a strip material by a row of finishing mills, the method comprising: cooling an upper surface and a lower surface of the strip material on an entry side of each of a first predetermined number of finishing mills during the finish rolling of the strip material to repeat surface cooling and finish rolling of the strip material sequentially until the last of the first predetermined number of finishing mills is reached, thereby restricting the thickness of a surface oxide film of the strip material to 5 μm or less. Thus, the temperature of the strip material is finally lowered to or below a predetermined temperature to reliably restrict the thickness of the surface oxide film to 5 μm or less. Consequently, scale defects can be eliminated and the quality of the resulting product can be improved.

According to a second aspect of the invention, there is provided a system for suppressing a surface oxide film during hot finish rolling, comprising: a finishing mill group including a plurality of finishing mills for finish rolling a strip material, the finishing mills being located in a row; and, a plurality of surface coolers for cooling an upper surface and a lower surface of the strip material to restrict the thickness of a surface oxide film of the strip material to about 5 μm or less, the surface coolers being located on an entry side of each of a first predetermined number of finishing mills of the finishing mill group. Thus, the surface cooling and the finish rolling of the strip material are repeated sequentially to lower the final temperature of the strip material below a predetermined temperature value. This reliably restricts the thickness of the surface oxide film to 5 μm or less. Consequently, scale defects can be eliminated, and the quality of the resulting product can be improved.

According to a third aspect of the invention, there is provided a system for suppressing a surface oxide film during hot finish rolling according to the second aspect of the invention and wherein the first, second and third surface coolers for cooling the upper and lower surfaces of the strip material are located on the entry side of first, second and third finishing mills, respectively, of the finishing mill group. Thus, the temperature of the strip material is lowered below a final predetermined temperature, without the need to upsize the suppressing system. Since the thickness of the surface oxide film is reliably restricted to about 5 μm or less, scale defects can be eliminated.

Having thus shown and described what is at present considered to be the preferred embodiment of this invention, it should be noted that the same has been made by way of illustration and not limitation. Accordingly all modifications, alterations and changes coming within the spirit and scope of the invention as set forth in the appended claims are meant to be included.

What is claimed is:

1. A system for suppressing a surface oxide film during hot finish rolling, comprising:

a finishing mill group including a plurality of finishing mills for finish rolling a strip material, said finishing mills being located in a row; and a plurality of surface coolers for cooling an upper surface and a lower surface of the strip material for restricting the thickness of a surface oxide film of the strip material to about 5 μm or less for preventing scale defects, said plurality of surface coolers being located on an entry side of each of a predetermined number of finishing mills of said plurality of finishing mills of the finishing group, said predetermined number of finishing mills being the first numbered finishing mills of said plurality of finishing mills.

2. The system for suppressing a surface oxide film during hot finish rolling according to claim 1, wherein a first, second and third surface coolers for cooling the upper and lower surfaces of the strip material are respectively located on an entry side of the first numbered finishing mills of said plurality of finishing mills.

3. The system of claim 1, wherein said plurality of surface coolers each apply at least about 4000 liters/min·$m^2$ of cooling liquid to the strip metal for restricting the thickness of the surface oxide film to about 5 μm or less, for preventing scale defects.

4. The system of claim 1, wherein said predetermined number of finishing mills comprises the first three finishing mills of said plurality of finishing mills.

5. A method for suppressing a surface oxide film during hot finish rolling of a strip material by a plurality of finishing mills located in a row in a finishing mill group, comprising:

cooling an upper surface and a lower surface of the strip material on an entry side of each of a predetermined number of finishing mills of said plurality of finishing mills during a finish rolling of the strip material, said predetermined number of finishing mills being the first numbered finishing mills in said row, restricting the thickness of a surface oxide film of the strip material to about 5 μm or less, in said finish numbered finishing mills to prevent scale defects, and finish rolling of the strip material sequentially until a last of the predetermined number of finishing mills is reached.

6. The method of claim 5, wherein said cooling step includes the step of applying at least about 4000 liters/min·$m^2$ of cooling liquid to the strip metal for restricting the thickness of the surface oxide to about 5 μm or less.

7. The method of claim 5, wherein said predetermined number of finishing mills comprises at least the first three finishing mills of said plurality of finishing mills.

* * * * *